United States Patent [19]

Gallusser et al.

[11] Patent Number: 4,678,260

[45] Date of Patent: Jul. 7, 1987

[54] EMI SHIELDED ELECTRICAL CONNECTOR

[75] Inventors: David O. Gallusser, Oneonta; Robert W. Brush, Sr., Unadilla; David W. MacAvoy, Bainbridge, all of N.Y.

[73] Assignee: Allied Corporation, Morris Township, Morris County, N.J.

[21] Appl. No.: 610,069

[22] Filed: May 14, 1984

[51] Int. Cl.[4] ..... H01R 4/66

[52] U.S. Cl. ..... 439/607

[58] Field of Search ..... 264/273; 339/143 R

[56] References Cited

U.S. PATENT DOCUMENTS

| | | | |
|---|---|---|---|
| 1,987,755 | 1/1935 | Skaer et al. | 339/143 R |
| 2,064,435 | 12/1936 | Loeffler | 264/273 |
| 2,876,274 | 3/1959 | Cole et al. | 339/143 R |
| 3,744,128 | 7/1973 | Fisher et al. | 339/143 R |
| 4,168,393 | 9/1979 | Silva | 264/295 |
| 4,349,241 | 9/1982 | Juris et al. | 339/143 R |

FOREIGN PATENT DOCUMENTS

| | | | |
|---|---|---|---|
| 1276103 | 10/1961 | France | 264/273 |

*Primary Examiner*—Gil Weidenfeld
*Assistant Examiner*—Gary F. Paumen
*Attorney, Agent, or Firm*—Anibal Jose Cortina

[57] ABSTRACT

The invention is an EMI shielded electrical connector characterized by a molded plastic housing (20) that has embedded therein an electrically conductive wire mesh (10). The wire mesh (10) includes an electrically exposed internal shoulder (11) and ends (12 and 13) that may be connected to other electrically conductive members to ground out unwanted electromagnetic interference.

9 Claims, 3 Drawing Figures

EMI SHIELDED ELECTRICAL CONNECTOR

This invention relates to electrical connectors, and more specifically, to an electrical connector shielded from electromagnetic interference (EMI).

In recent years a need has developed, particularly in the aerospace industry and in military applications, for electrical connectors having effective shielding against electromagnetic interference (EMI). In certain military applications, the connector must have the ability to withstand severe EMI conditions sometimes referred to as electromagnetic pulses (EMP). The shielded electrical connectors are used to prevent EMI signals from interfering with the electrical signals carried through the wires and mated contacts within the connector. One example of such a connector may be found in U.S. Pat. No. 4,349,241 entitled "Electrical Connector Assembly Having Enhanced EMI Shielding," issued Sept. 14, 1982. Recently, because of a need for a lighter and less expensive EMI shielded connector, thermoplastic materials employing various conductive particles (fillers) have been molded to form a connector housing having some degree of EMI shielding. Conductive fillers such as carbon, graphite, metal flake, metal plated glass fibers and spheres have been utilized. However, the effectiveness of the shielding of such a connector depends greatly on the homogeneity of the particles and plastic material. Ideally, the final molded part must provide point-to-point contact between the conductive particles in the plastic to obtain an overall conductivity. However, due to the flow patterns in the molding process, an uneven distribution of the particles frequently results. This causes "EMI holes" in the molded connector housing that provide a path for electromagnetic interference to pass.

Another approach has been to plate the outside of a plastic connector housing with a metal material. However, the plating on the outside is subject to wear and scratching which leaves unplated surfaces. These unplated surfaces allow electromagnetic interference to pass through the walls of the connector housing.

Accordingly, it has been a problem for some time to provide a light weight low cost EMI connector, especially a molded plastic connector that effectively shields against electromagnetic interference.

SUMMARY OF THE INVENTION

This invention provides an EMI shielded connector and method of making the connector that is more effective than previous prior art molded plastic electrical connectors. The invention is characterized by an electrically conductive wire mesh or foraminous metal sleeve embedded in a plastic housing, the inside and outside surfaces of the sleeve are completely covered with plastic, leaving the electrically conductive mesh exposed at the ends thereof.

Accordingly, it is an advantage of this invention to provide a molded plastic connector that acceptably attenuates electromagnetic interference.

It is also an advantage of this invention to provide an EMI shielded electrical connector that is lighter in weight and less costly to produce than EMI shielded connectors comprised of metal.

DETAILED DISCUSSION OF THE INVENTION

Figure 1:
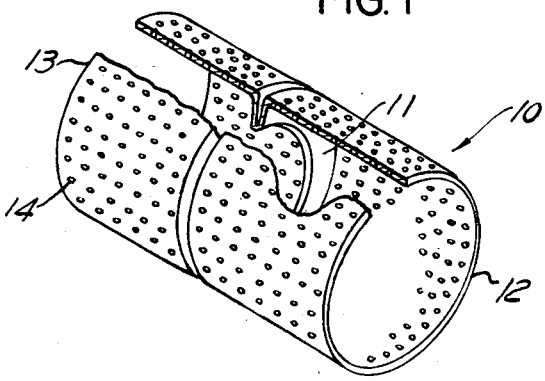
FIG. 1 illustrates a foraminous metal sleeve.

Referring now to the drawings, FIG. 1 illustrates a foraminous metal sleeve 10. The sleeve 10 includes opposite ends 12 and 13, a radially inwardly extending shoulder 11, and a plurality of holes 14. Preferably, the sleeve 10 is comprised of a wire mesh where the size of the holes 14 are between 8 to 12 millimeters (0.003 to 0.005 inches).

Figure 2:
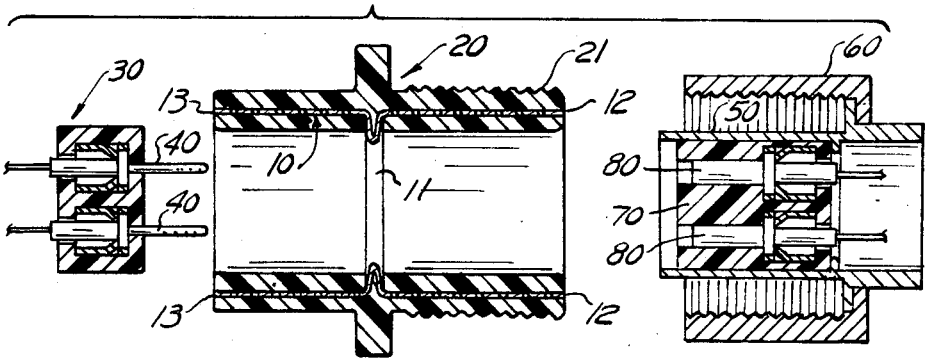
FIG. 2 illustrates an exploded view of an electrical connector assembly incorporating the principles of the invention.

FIG. 2 illustrates an exploded view of an electrical connector assembly that includes a first electrical connector housing 20; an insert 30 with contacts 40; and a second connector housing 50 having a coupling nut 60 and an insert 70 that includes a plurality of mating contacts 80 mounted in the insert 70. The first connector housing 20 has embedded (molded) therein the foraminous metal sleeve 10 shown in FIG. 1. Each end 12 and 13 of the sleeve 10 and the internal radially inwardly extending shoulder 11 are electrically exposed, i.e., not covered with plastic material so that they may contact other electrically conductive materials, (not shown), to ground out electromagnetic interference. The outer forward portion of the first housing 20 includes a plurality of threads 21 adapted to mate with threads 61 on the inside of the coupling nut 60 rotatably mounted to the second connector housing 50.

Figure 3:
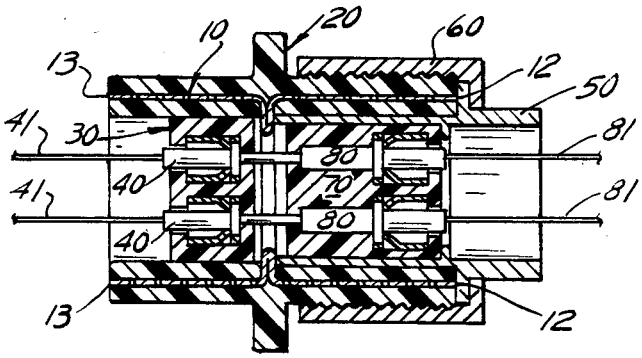
FIG. 3 illustrates an assembled and mated connector assembly incorporating the principles of the invention.

FIG. 3 is an EMI shielded connector assembly wherein the first connector housing 20 is connected to the second connector housing 50 by the coupling nut 60. This figure illustrates how the forward end of the second connector housing 50 electrically contacts the internal shoulder 11 of the first housing 20, and one end 12 of the electrically conductive foraminous metal sleeve 10 electrically contacts another portion of the second housing 50. Electrically conductive members (not shown) may be attached to the second connector body 50 and the rear end 13 of the sleeve 10 in the first connector body 20 to ground out unwanted electromagnetic interference, thereby eliminating interference with any electrical signals passing through the wires 41 and 81 and the mated contacts 40 and 48.

The plastic connector housing 20 shown in FIGS. 2 and 3 is fabricated as follows: first a foraminous piece of metal or wire mesh is formed into a tubular member having a radially inwardly extending shoulder as shown in FIG. 1; the formed tubular member 10 is then placed in a mold which is then filled with a thermosetting plastic material to form the outer body 20 as is shown in FIG. 2. The size of the holes 14 in the tubular member 10 are selected to allow maximum flow of the plastic material during the molding process while at the same time providing acceptable attenuation of electromagnetic interference over a frequency range of 0.1 to 10 gigahertz. With a hole size of between 8 to 12 millimeters (0.003 to 0.005 inches) and a hole density of about 50 holes per inch, 80 db of attenuation is achieved at 0.1 gigahertz which drops off logarithmically to 45 db at 10 gigahertz. Varying the hole size will vary the attenuation. If the holes are made too small, some of the plastic material during the molding process will not pass through the holes, forming voids which weaken the mechanical strength of the connector housing.

Having described the invention what is claimed is:

1. In combination with an EMI shielded connector assembly of the type having a tubular plastic outer housing; a dielectric insert having a plurality of axial passages therein, said insert mounted in said plastic outer housing; and a plurality of electrically conductive contacts mounted in respective passages in said dielectric insert, the improvement wherein said plastic outer housing is characterized by:

an electrically conductive foraminous sleeve embedded in the plastic outer housing, the inside surface and outside surface of said sleeve completely covered by the material of said plastic housing; and an electrically conductive annular shoulder extending radially inward from said tubular plastic housing, said conductive annular shoulder electrically connected to said electrically conductive foraminous sleeeve, and the ends of said sleeve and said shoulder being exposed for electrical connection in direct contact with another electrically conductive member extending within the interior of said plastic housing.

2. The EMI shielded connector as recited in Claim 1 wherein said foraminous sleeve is comprised of an electrically conducting wire mesh having a plurality of holes substantially evenly distributed throughout said sleeve, and said annular shoulder is an integral part of said mesh.

3. The EMI shielded connector as recited in claim 2 wherein the holes in said sleeve are about 8–12 millimeters (0.003–0.005 inches) in size.

4. The EMI shielded connector as recited in claim 3 wherein said plastic housing is molded in a manner such that substantially all of said holes are filled with plastic material of said housing.

5. The EMI shielded connector as recited in claim 3 wherein said holes are substantially evenly distributed throughout said sleeve at a hole density of about 50 holes per inch.

6. The EMI shielded connector as recited in claim 4 wherein said holes are substantially evenly distributed throughout said sleeve at a hole density of about 50 holes per inch.

7. In combination with an EMI shielded connector assembly of the type having a tubular plastic outer housing; a dielectric insert having a plurality of axial passages therein, said insert mounted in said plastic outer housing; and a plurality of electrically conductive contacts mounted in respective passages in said dielectric insert, the improvement wherein said plastic outer housing is characterized by:

an electrically conductive foraminous sleeve embedded in the plastic outer housing, the inside surface and outside surface of said sleeve completely covered by the material of said plastic housing, said foraminous sleeve being comprised of an electrically conductive wire mesh having a plurality of holes substantially evenly distributed throughout said sleeve, and with said plastic housing molded in a manner such that substantially all of said holes are filled with plastic material of said housing whereby the mechanical strength of the connector housing is strengthened; and an electrically conductive annular shoulder extending radially inward from said tubular plastic housing, said conductive annular shoulder electrically connected to said electrically conductive foraminous sleeve and being an integral part thereof, and the ends of said sleeve and said inwardly extending shoulder being exposed for electrical connection in direct contact with another electrically conductive member extending within the interior of said plastic housing.

8. The EMI shielded connector as recited in claim 7 wherein the holes in said sleeve are about 8–12 millimeters (0.003–0.005 inches) in size.

9. The EMI shielded connector as recited in claim 7 wherein said holes are distributed throughout said sleeve at a hole density of about 50 holes per inch.

* * * * *